US006863560B2

(12) United States Patent
Brandstatter et al.

(10) Patent No.: US 6,863,560 B2
(45) Date of Patent: Mar. 8, 2005

(54) ELECTRICAL POWER PLUG WITH SECURE POSITIONING OF THE CONTACT PRONGS

(75) Inventors: Dietmar Brandstatter, Markt Piesting (AT); Walter Hammer, Sollenau (AT)

(73) Assignee: Feller GmbH, Günselsdorf (AT)

( * ) Notice: Subject to any disclaimer, the term of this patent is extended or adjusted under 35 U.S.C. 154(b) by 0 days.

(21) Appl. No.: 10/725,970

(22) Filed: Dec. 2, 2003

(65) Prior Publication Data

US 2004/0110413 A1 Jun. 10, 2004

Related U.S. Application Data

(60) Provisional application No. 60/431,189, filed on Dec. 5, 2002.

(30) Foreign Application Priority Data

Dec. 5, 2002 (AT) ..... 1822/2002

(51) Int. Cl.[7] ..... H01R 29/00
(52) U.S. Cl. ..... 439/518; 439/595; 439/695
(58) Field of Search ..... 439/518, 106, 439/606, 736, 738, 685, 695, 697

(56) References Cited

U.S. PATENT DOCUMENTS

| | | | | | |
|---|---|---|---|---|---|
| 4,405,194 | A | * | 9/1983 | van Lierop | 439/622 |
| 4,790,776 | A | * | 12/1988 | Iijima | 439/695 |
| 5,282,753 | A | * | 2/1994 | Su | 439/106 |
| 5,662,484 | A | * | 9/1997 | Blanche | 439/106 |
| 6,168,443 | B1 | * | 1/2001 | Mullen et al. | 439/106 |
| 6,190,212 | B1 | * | 2/2001 | Brown et al. | 439/736 |
| 6,454,612 | B1 | * | 9/2002 | Wang | 439/694 |

FOREIGN PATENT DOCUMENTS

| | | |
|---|---|---|
| EP | 0 616 389 A2 | 9/1994 |
| GB | 2 251 739 A | 7/1992 |
| GB | 2 341 495 A | 3/2000 |

* cited by examiner

*Primary Examiner*—Hae Moon Hyeon
(74) *Attorney, Agent, or Firm*—Henry M. Feiereisen

(57) ABSTRACT

An electrical plug includes at least one contact prong defining a longitudinal axis, and a carrier plate having an aperture for receiving the contact prong. The contact prong is provided in the direction of the longitudinal axis with a first stop and a second stop, which acts in opposition to the first stop, for force-fitting engagement of the contact prong with the carrier plate.

14 Claims, 3 Drawing Sheets

ELECTRICAL POWER PLUG WITH SECURE POSITIONING OF THE CONTACT PRONGS

CROSS-REFERENCES TO RELATED APPLICATIONS

This application claims the benefit of prior filed U.S. provisional Application No. 60/431,189, filed Dec. 5, 2002, pursuant to 35 U.S.C. 119(e), the disclosure of which is incorporated herein by reference.

This application claims the priority of Austrian Patent Application, Serial No. A 1822/2002, filed Dec. 5, 2002, pursuant to 35 U.S.C. 119(a)–(d), the disclosure of which is incorporated herein by reference.

BACKGROUND OF THE INVENTION

The present invention relates, in general, to an electrical power plug, and to a method of making such an electrical power plug.

An electrical power plug of a type involved here has a carrier plate and a plurality of contact prongs which are received in assigned apertures of the carrier plate. Subsequently, the carrier plate and part of each contact prong are cast in a mold. These known power plugs have the drawback that faulty positions of the contact prong can easily be encountered in the power plug so that the reject rate is increased during production and/or the service life and reliability of the conventional power plug is decreased. Further, an inadvertent movement of the power plug may cause two contacts in the power plug to touch one another.

It would therefore be desirable and advantageous to provide an improved electrical power plug to obviate prior art shortcomings and to ensure a precise positioning of the contact prongs, while still being simple in structure to allow manufacture in an easy and cost-efficient manner.

SUMMARY OF THE INVENTION

According to one aspect of the present invention, an electrical power plug includes a contact prong, which defines a longitudinal axis, and a carrier plate having an aperture for receiving the contact prong, wherein the contact prong is provided in the direction of the longitudinal axis with a first stop and a second stop, which acts in opposition to the first stop, for force-fitting connection of the contact prong with the carrier plate.

The present invention resolves prior art problems by securing the contact prong in relation to the carrier plate in a definite position via the first and second stops. As soon as the contact prong is urged by force into connection with the carrier plate, its position can no longer change so that handling of the power plug, in particular during subsequent manufacturing steps, is considerably simplified. As a consequence, the power plug according to the invention can be manufactured in a simple and cost-efficient manner. The forced positioning is able to prevent in particular a shift and/or rotation of the contact prongs so that the risk of an inadvertent contacting and/or formation of a spark discharge in the power plug according to the invention is significantly reduced, thereby enhancing the safety and reliability of the power plug according to the invention.

According to another feature of the invention, the first stop may be configured—as viewed in longitudinal direction of the contact prong—by an abutment which is sized to exceed the cross section of the aperture, and may form a crimp area, solder area or the like, of the contact prong. As a result of this configuration of the first stop, the movement of the contact prong through the aperture can be limited easily and effectively.

According to another feature of the invention, a detent may be formed on the carrier plate for engagement with the second stop. In this way, the forced engagement between the contact prong and the carrier plate may be realized in a simple and secure manner.

According to another feature of the invention, the contact prong extends forward from a bottom side of the carrier plate and terminates in a prong end distal to the first and second stops, wherein the prong end may be chamfered or rounded. The chamfered or rounded prong end of the contact prong facilitates installation of the contact prong in the aperture.

According to another feature of the invention, the carrier plate may include an opening for receiving a catch or like locking element of a protective cap. In view of the interaction between the opening and the catch, a connection between the carrier plate and the protective cap can be implemented in a simple, rapid and reliable manner.

According to another feature of the invention, the protective cap may be provided with a spacer element which interacts with the second stop of the contact prong. The provision of the spacer element interacting with the second stop ensures a precise and forced positioning of the contact prong in relation to the carrier plate.

According to another feature of the invention, at least two contact prongs may be provided, and at least one partition wall may be formed on the carrier plate to shield the contact prongs from one another. The partition wall effectively prevents an inadvertent contacting of the contact prongs and/or the formation of a spark discharge or the like so that the safety, service life and reliability of the power plug according to the invention can be improved.

According to another feature of the invention, the carrier plate and the protective cap may be enveloped, in particular encapsulated, by an outer layer. This results in a particular robust and safe power plug.

According to another aspect of the invention, a method of making an electrical power plug, includes the steps of providing a carrier plate having a flexible detent and formed with an aperture intended for receiving a contact prong, shaping an end of the contact prong into a chamfered or rounded configuration, inserting the contact prong end of the contact prong through the aperture, thereby deforming the detent, whereby a movement of the contact prong through the aperture is limited by a first stop of the contact prong, and the detent engages behind a second stop of the contact prong.

Thus, the contact prong can be pushed in one working step through the aperture and can be connected in a force-fitting manner with the carrier plate, thereby realizing a precise positioning of the contact prong in one working step.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
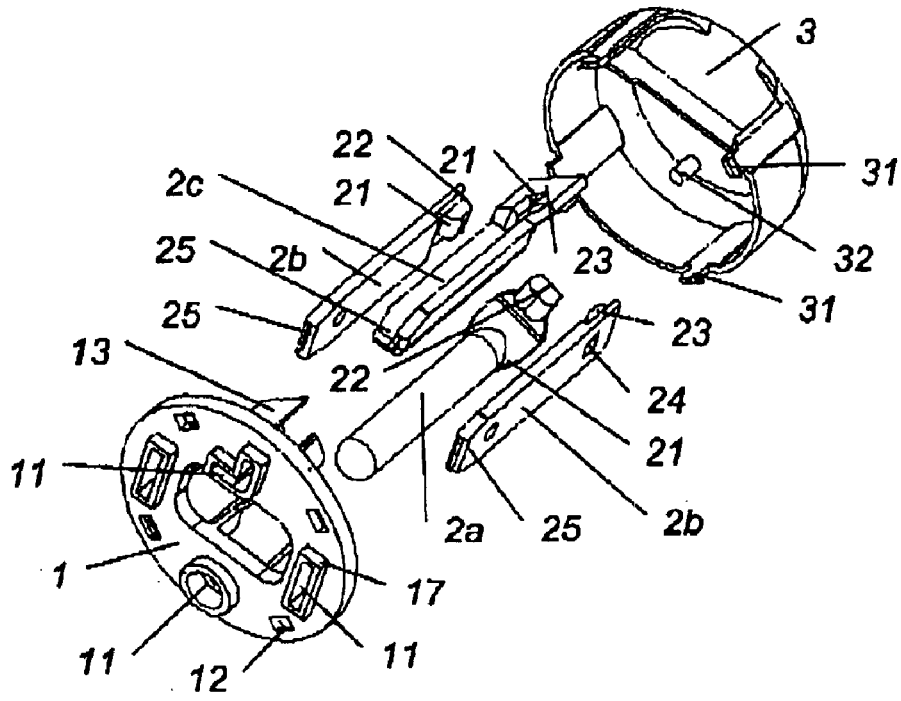
FIG. 1 is a perspective view, in exploded representation, of an embodiment of an electrical power plug according to the present invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

As used in the specification and claims, the term "contact prong" is intended generically to connote a circular contact prong, a flat blade contact or variously-shaped contact prongs or other contact members insertable into power or ground outlets configured according to any of a plurality of national standards.

FIGS. 1 to 7 show an embodiment of an electrical power plug according to the invention with a plug housing comprised of a carrier plate 1 and a protective cap 3. The carrier plate 1 has a plurality of apertures 11 for receiving respective contact prongs 2*a*, 2*b*, 2*c*. The number and configuration of contact prongs are typically governed by national and/or international standards or comparable regulations. In the non-limiting example of FIGS. 1 to 7, the electrical power plug has four contact prongs 2*a*, 2*b*, 2*c*, with one contact prong 2*a* of cylindrical configuration, two contact prongs 2*b* in the form of thin rectangular blades, and one contact prong 2*c* of L-shaped configuration. Of course, other embodiments of the power plug according to the invention may be provided with a different number or configuration of contact prongs.

Each of the contact prongs 2*a*, 2*b*, 2*c* is connected—as viewed in direction of its longitudinal axis—in force-fitting manner with the carrier plate 1 by means of at least a first stop 21 and a second stop 22 which acts in opposition to the first stop 21. As a result, the contact prongs 2*a*, 2*b*, 2*c* are held in a predetermined position so that an inadvertent rotation, shift or the like is prevented.

The carrier plate 1 further includes openings 12 for receiving respective flexible and resilient catches 31 or like locking members of the protective cap 3. Hereby, the number and configuration of the openings 12 and the catches 31 can be randomly selected.

The stop 21 may be configured in the form of an abutment 23 which—as viewed in longitudinal direction of the contact prong—is sized to exceed the cross section of the pertaining aperture 11 so that the movement of the contact prong 2*a*, 2*b*, 2*c* is limited in a simple and effective manner by the aperture 11. The configuration of the abutment 23 may hereby be best suited to the type of contact prong selected. As shown in particular in FIGS. 4 and 7, the carrier plate 1 further supports a post 16 for engagement with the first stop 21. The projecting abutment 23 may be configured in particular as crimp area, solder area or the like.

Figure 2:
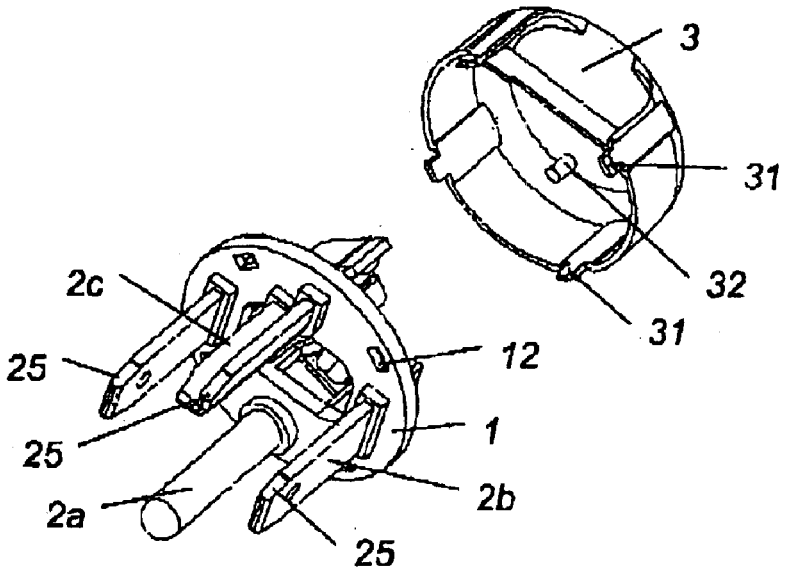
FIG. 2 is a perspective view of the power plug of FIG. 1 in partly assembled state with detached protective cap.
Figure 3:
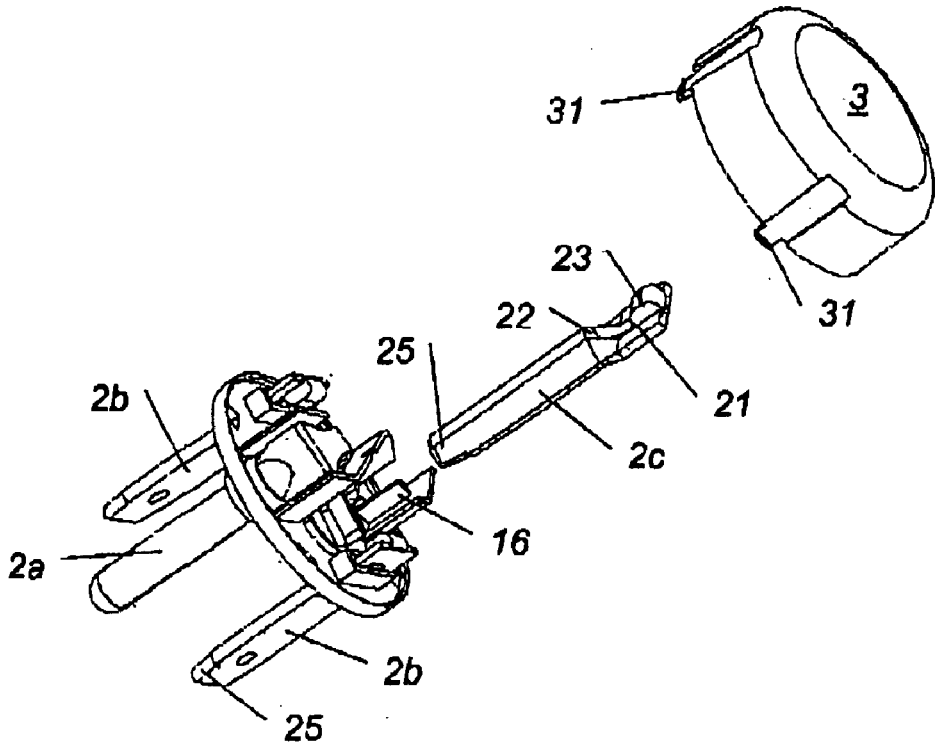
FIG. 3 is a perspective view of the power plug of FIG. 1 in partly assembled state with detached protective cap and detachment of one contact prong.

In the embodiment of FIGS. 1 to 7, the protective cap 3 has spacer elements 32 which interact with the stops 22 of the contact prongs 2*a*, 2*b*, 2*c*. For sake of simplicity and convenience, only one spacer element 32 is shown in FIGS. 1 and 2 and intended to rest against the stop 22 of the contact prong 2*a*. The spacer elements 32 may be configured as a brace, protrusion or the like. The spacer elements 32 engage the second stops 22 of the contact prongs 2*a*, 2*b*, 2*c* as the protective cap 3 is snapped onto the carrier plate 1 via the catches 31. Thus, the precise positioning of the contact prongs 2*a*, 2*b*, 2*c* does not require a separate working step so that the assembly of the power plug according to the invention is simple and requires only a small number of working steps and machineries. Moreover, the overall manufacturing process can be realized in a cost-efficient manner.

Figure 4:
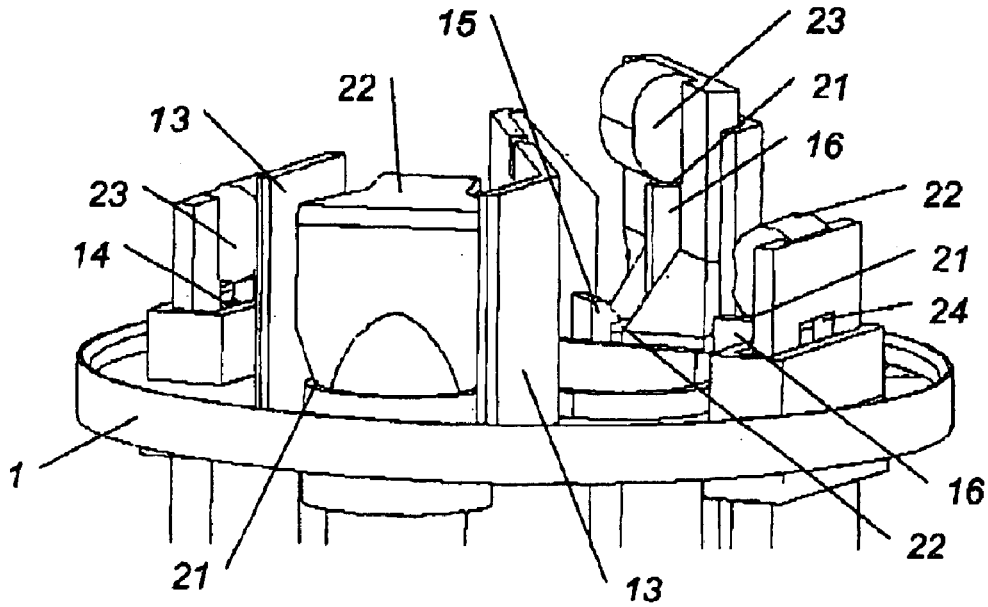
FIG. 4 is a top perspective view upon the carrier plate with removed protective cap.
Figure 5:
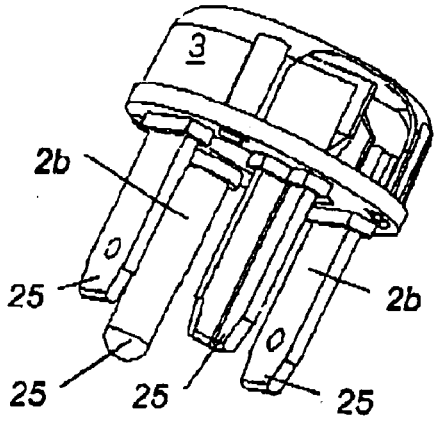
FIG. 5 is a perspective view from below upon the power plug of FIG. 1 with part of the protective cap broken away.

As shown in particular in FIG. 4 with respect to the contact prong 2*c*, the carrier plate 1 further supports a detent 15 for hooked engagement with the stop 22. Thus, as the contact prong 2*c* is inserted through the aperture 11, a force-fitting engagement of the contact prong 2*c* with the carrier plate 1 is realized via the stop 21 as well as via the stop 22 in conjunction with the detent 15 and the post 16, respectively.

As shown by way of example in FIGS. 1 and 4, the contact prong 2*b* may include a depression 24, in particular a recess, to form the stop 21 for engagement by a finger 14 (FIG. 4) or the like that projects from the carrier plate 1.

In order to facilitate the insertion of each contact prong 2*a*, 2*b*, 2*c* into the apertures 11, the contact prongs 2*a*, 2*b*, 2*c* have a prong end 25 which extends forward from the bottom face of the carrier 1 and has a chamfered or rounded configuration. As shown by way of example in FIG. 3, the contact prong 2*a* has a rounded prong end 25 whereas the contact prongs 2*b*, 2*c* have chamfered prong ends 25. The chamfered or rounded configuration of the prong end 25 of the contact prongs 2*a*, 2*b*, 2*c* also facilitates the elastic deformation of the detent 15.

Figure 6:
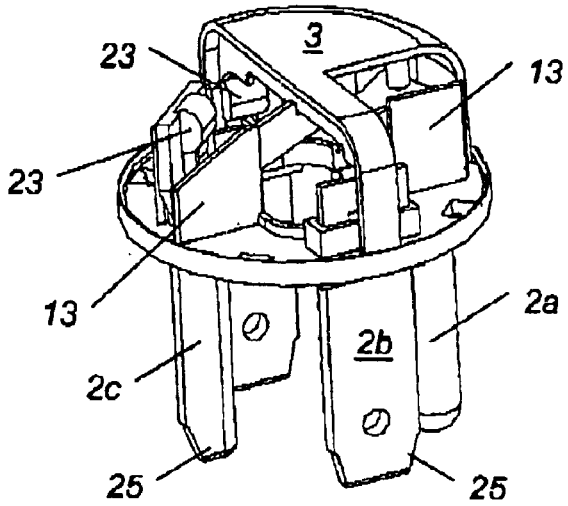
FIG. 6 is a top perspective view of the power plug of FIG. 1, with parts of the protective cap being broken away.
Figure 7:
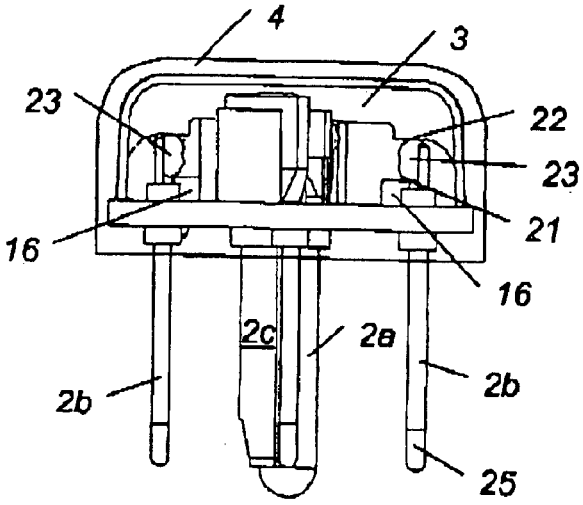
FIG. 7 is a side view of the power plug of FIG. 1, with parts of the protective cap broken away.

Suitably, the carrier plate 1 further supports partition walls 13 for shielding adjacent contact prongs 2*a*, 2*b*, 2*c* from one another, as shown in particular in FIGS. 4 and 6. This effectively prevents an inadvertent electrically conducting contact between two of the contact prongs 2*a*, 2*b*, 2*c* within the power plug according to the invention, thereby enhancing the reliability and service life.

The carrier plate 1 and the protective cap 3 may be enveloped, in particular encapsulated, by an outer layer 4 (FIG. 7), so that the carrier plate 1 and the protective cap 3 become inaccessible for a user and accidents can be substantially avoided as a result of improper handling of the power plug by the user.

The contact prongs 2 are connected, especially compressed, with the wires of a power line.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An electrical power plug, comprising:

a contact prong defining a longitudinal axis; and a carrier plate having an aperture for receiving the contact prong and including an engagement member and a detent extending from the carrier plate, wherein the contact prong is provided in the direction of the longitudinal axis with a first stop, which interacts with the engagement member, and a second stop, which is engageable by the detent and acts in opposition to the first stop, for force-fitting engagement of the contact prong with the carrier plate.

2. The power plug of claim 1, wherein the first stop is configured as an abutment which exceeds a cross section of the aperture of the carrier plate.

3. The power plug of claim 1, wherein the detent has a hook-shaped configuration.

4. The power plug of claim 1, wherein the contact prong extends forward from a bottom side of the carrier plate and terminates in a contact prong end distal to the first and second stops, said contact prong end being chamfered.

5. The power plug of claim 1, wherein the contact prong extends forward from a bottom side of the carrier plate and terminates in a contact prong end distal to the first and second stops, said contact prong end being rounded.

6. The power plug of claim 1, wherein the carrier plate has an opening, and further comprising a protective cap connected to the carrier plate and having a catch for engagement in the opening of the carrier plate.

7. The power plug of claim 6, wherein the catch has a hook-shaped configuration.

8. The power plug of claim 6, wherein the protective cap includes a spacer element which interacts with the second stop of the contact prong.

9. The power plug of claim 1, and further comprising a further said contact prong, and a partition wall formed on the carrier plate to shield the contact prongs from one another.

10. The power plug of claim 6, and further comprising an outer layer for enveloping the carrier plate and the protective cap.

11. The power plug of claim 1, wherein the first stop is configured as a depression for engagement of a finger extending from the carrier plate.

12. The power plug of claim 1, wherein the engagement member is a post, said post and said detent extending upright from the carrier plate.

13. The power plug of claim 2, wherein the engagement member supports the abutment from underneath.

14. A method of making a power plug, comprising the steps of:

providing a carrier plate having an elastic detent and an engagement member, said carrier plate being formed with an aperture intended for receiving a contact prong;

shaping a prong end of the contact prong into a chamfered or rounded configuration;

inserting the prong end of the contact prong through the aperture, thereby elastically deforming the detent, whereby a movement of the contact prong through the aperture is limited by a first stop of the contact prong through interaction with the engagement member, and the detent engages behind a second stop of the contact prong.

* * * * *